US009068533B2

(12) United States Patent
Kullik et al.

(10) Patent No.: US 9,068,533 B2
(45) Date of Patent: Jun. 30, 2015

(54) HANDHELD WORK APPARATUS

(75) Inventors: Evelyn Kullik, Gerlingen (DE); Philipp Neumann, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 816 days.

(21) Appl. No.: 13/330,386

(22) Filed: Dec. 19, 2011

(65) Prior Publication Data

US 2012/0318236 A1 Dec. 20, 2012

(30) Foreign Application Priority Data

Jun. 17, 2011 (DE) ..... 10 2011 105 159

(51) Int. Cl.

| | |
|---|---|
| ***F02M 25/07*** | (2006.01) |
| ***F02M 1/02*** | (2006.01) |
| ***F02B 63/02*** | (2006.01) |
| ***F02D 11/04*** | (2006.01) |

(52) U.S. Cl.

CPC ..... *F02M 1/02* (2013.01); *F02B 63/02* (2013.01); *F02D 11/04* (2013.01)

(58) Field of Classification Search

CPC ..... F02M 1/02; F02M 1/00; F02M 1/10; F02D 41/062; F02D 41/064; F02D 41/065; F02D 41/067

USPC ..... 123/179.16, 179.18, 198 R, 437, 685; 261/39.1, 64.6; 83/788–820

See application file for complete search history.

(56) References Cited

U.S. PATENT DOCUMENTS

| | | | | |
|---|---|---|---|---|
| 3,575,385 | A * | 4/1971 | Szwargulski et al. | 261/23.2 |
| 5,537,964 | A * | 7/1996 | Hoshiba | 123/179.18 |
| 5,611,312 | A * | 3/1997 | Swanson et al. | 123/436 |
| 6,550,749 | B2 * | 4/2003 | Vick | 261/52 |
| 6,641,118 | B2 * | 11/2003 | Schliemann | 261/52 |
| 7,337,757 | B2 * | 3/2008 | Schmidt et al. | 123/179.16 |
| 7,377,496 | B2 * | 5/2008 | Toda et al. | 261/43 |
| 7,611,131 | B2 * | 11/2009 | Engman et al. | 261/64.1 |
| 8,408,525 | B2 * | 4/2013 | Grater et al. | 261/47 |
| 8,511,650 | B2 * | 8/2013 | Kern et al. | 261/52 |
| 8,714,137 | B2 * | 5/2014 | Doering et al. | 123/337 |
| 8,857,407 | B2 * | 10/2014 | Furuya | 123/330 |

* cited by examiner

*Primary Examiner* — Erick Solis
*Assistant Examiner* — Carl Staubach
(74) *Attorney, Agent, or Firm* — Walter Ottesen P.A.

(57) ABSTRACT

A work apparatus has an engine with a carburetor. An actuating element is connected to the choke shaft of the choke element of the carburetor. An operating mode selector has operating, warm start and cold start positions and is connected fixedly in terms of rotation to an adjusting element. The actuating element is pivoted through a pivot angle ($\alpha_1$) from the operating position into the warm start position and through a pivot angle ($\alpha_2$) from the warm start position into the cold start position. The selector is pivoted through a pivot angle ($\gamma_1$) from the operating position into the warm start position and through a pivot angle ($\gamma_2$) from the warm start position into the cold start position. The ratio of the pivot angle ($\alpha_2$) to the pivot angle ($\alpha_1$) is at least approximately 1.5 times the ratio of the pivot angle ($\gamma_2$) to the pivot angle ($\gamma_1$).

20 Claims, 4 Drawing Sheets

HANDHELD WORK APPARATUS

CROSS REFERENCE TO RELATED APPLICATION

This application claims priority of German patent application no. 10 2011 105 159.0, filed Jun. 17, 2011, the entire content of which is incorporated herein by reference.

BACKGROUND OF THE INVENTION

Handheld work apparatuses driven by a combustion engine are generally known. It is also known to set a warm start position and a cold start position via an operating mode selector of the work apparatus. The operating mode selector actuates the choke element via an adjusting element.

SUMMARY OF THE INVENTION

It is an object of the invention to provide a handheld work apparatus of the type described above which has a simple configuration and is ergonomic to operate.

The portable handheld work apparatus of the invention includes: a work tool; a combustion engine for driving the work tool; the combustion engine including a carburetor for supplying an air/fuel mixture; the carburetor including a throttle element and a choke element accommodated therein; the choke element having a choke shaft defining a first pivot axis; the choke element being mounted in the carburetor with the choke shaft so as to be pivotable about the first pivot axis; the choke element including an actuating element operatively connected to the choke shaft; a throttle lever; an operating-mode selector mounted in the apparatus so as to be pivotable about a second pivot axis to an operating position, a warm-start position and a cold-start position; an adjusting element connected to the operating-mode selector so as to be fixedly rotatable therewith and coact with the actuating element in the warm-start position and the cold-start position; the adjusting element having a first contact location corresponding to the warm-start position and a second contact location corresponding to the cold-start position; the actuating element having a first contact location corresponding to the warm-start position and a second contact location corresponding to the cold-start position; the choke element being displaced in a closing direction in response to a shift of the operating-mode selector from the warm-start position whereat the first contact location of the adjusting element coacts with the first contact location of the actuating element into the cold-start position whereat the second contact location of the adjusting element coacts with the second contact location of the actuating element; the actuating element being pivoted through a first pivot angle ($\alpha_1$) when pivoted from the operating position into the warm-start position and through a second pivot angle ($\alpha_2$) when pivoted from the warm-start position into the cold-start position; whereas, the operating-mode selector being pivoted through a third pivot angle ($\gamma_1$) when the operating-mode selector is pivoted from the operating position into the warm-start position and through a fourth pivot angle ($\gamma_2$) when pivoted from the warm-start position into the cold-start position; and, wherein a ratio of the second pivot angle ($\alpha_2$) to the first pivot angle ($\alpha_1$) is at least approximately 1.5 times a ratio of the fourth pivot angle ($\gamma_2$) to the third pivot angle ($\gamma_1$).

It is desirable that the operating mode selector is pivoted by the same angle between the operating position, warm start position and the cold start position in order to achieve comfortable and ergonomic operation. The choke element is pivoted by a small pivot angle between the operating position and the warm start position and is pivoted by a substantially larger pivot angle between the warm start position and the cold start position in order to achieve a good starting behavior. Because the ratio of the pivot angle of the actuating element from the warm start position into the cold start position to the pivot angle from the operating position into the warm start position is at least approximately 1.5 times the ratio of the corresponding pivot angle of the operating mode selector, the choke element is pivoted by a larger angle into the cold start position than into the warm start position for the same pivot angle of the operating mode selector. Thus, ergonomic actuation and a good starting behavior are achieved. Thereby, an empty run can be provided, so that for example the operating mode selector must first be pivoted through a predetermined angle until the adjusting element and the actuating element engage one another and the actuating element is also pivoted.

Advantageously, the first contact point of the actuating element and/or the adjusting element and the second contact point of this element has an angular distance in the peripheral direction to the corresponding first pivot axis or second pivot axis which is at least approximately 4°. The angular distance is, in particular, selected so that the angular distance when adjusting the operating mode selector from the warm start position into the cold start position requires an additional movement of the choke element in the closing direction. Thereby, the angle through which the operating mode selector must be adjusted to fully close the choke element becomes smaller. Contact points with an angular distance in the peripheral direction can be easily realized constructionally.

Advantageously, the angular distance between the contact points of the actuating element or the adjusting element is more than approximately 10°, in particular more than approximately 15°. Thus, the adjustment angle of the operating mode selector from the warm start position to the cold start position is substantially reduced.

Advantageously, the angular distance is provided between the first and the second contact points of the adjusting element. The second contact point is offset in the adjustment direction of the adjustment element from the warm start position to the cold start position relative to the first contact point. Advantageously, the second contact point has a smaller distance to the second pivot axis of the adjustment element than the first contact point. Thus, different transmission ratios of the pivot movement of the operating mode selector to the pivot movement of the choke element are achieved.

Additionally or alternatively it can be provided that the first and the second contact point have an angular distance to each other at the actuating element. In order to achieve an additional movement of the choke element in the closing direction it is provided that the second contact point lies offset in the direction opposite the closing direction of the choke element relative to the first contact point.

Advantageously, the ratio of the distance of the first contact point of the actuating element from the first pivot axis to the distance of the first contact point of the adjusting element from the second pivot axis is larger than the ratio of the distance of the second contact point of the actuating element from the first pivot axis to the distance of the second contact point of the adjusting element from the second pivot axis. The ratio of the distances of the first contact points from the corresponding pivot axes thereby characterizes the transmission ratio of the arrangement. At a constant pivot speed of the operating mode selector, the choke element is pivoted more quickly in the area of the cold start position than in the area of the warm start position. In the area of the warm start position a more precise setting of the position of the choke element is possible and manufacturing tolerances can be better compensated because of the larger transmission ratio. In the cold start position the choke element is typically completely closed and is pressed against a stop, so that no exact position setting is necessary here. The choke element is partially open in the warm start position. A change in the position of the choke element by a few angle degrees here already effects a substantial change of the free flow cross-section of the intake channel. For a good starting behavior in a warm start it is for this reason advantageous to have an exact setting of the position of the choke element. The transmission ratio in the cold start position is advantageously at least approximately double as large as in the warm start position.

Advantageously, the second contact point on the actuating element has a smaller distance from the first pivot axis of the actuating element than the first contact point. Thereby, it is achieved in a simple manner that the transmission ratio in the cold start position is smaller than in the warm start position.

Advantageously, the second contact point on the adjusting element has a larger distance from the second pivot axis of the adjusting element than the first contact point on the adjusting element.

The actuating element is pivoted by a first pivot angle from the operating position into the warm start position and by a second pivot angle from the warm start position to the cold start position. The second pivot angle is advantageously at least approximately one and a half times as large as the first pivot angle.

A simple configuration is achieved if the first contact point is formed on a first actuating bolt and the second contact point is formed on a second actuating bolt. The actuating element advantageously carries the actuating bolts. However, it is also possible for the first contact point and the second contact points to be formed on a cam contour. The cam contour is advantageously flat and inclined by an angle that is advantageously between approximately 10° and approximately 50° with respect to the radial direction of the associated pivot axis. The cam contour is advantageously arranged on the outer side of a lever. The actuating element advantageously comprises the cam contour.

A simple configuration is achieved if the operating mode selector and the actuating element are arranged on one common actuating shaft, in particular are formed integrally therewith.

Advantageously, not only the choke element but also the throttle element is adjusted into a cold start position and a warm start position. A simple configuration is achieved if a first coupling element, which interacts with a second coupling element arranged on the throttle lever and pivots the throttle lever when the operating mode selector is adjusted into the warm start position or the cold start position, is arranged on the actuating shaft. Accordingly, the throttle element is not actuated directly via the actuating shaft, but rather indirectly by adjustment of the throttle lever which acts on the throttle element. This results in a simple construction.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
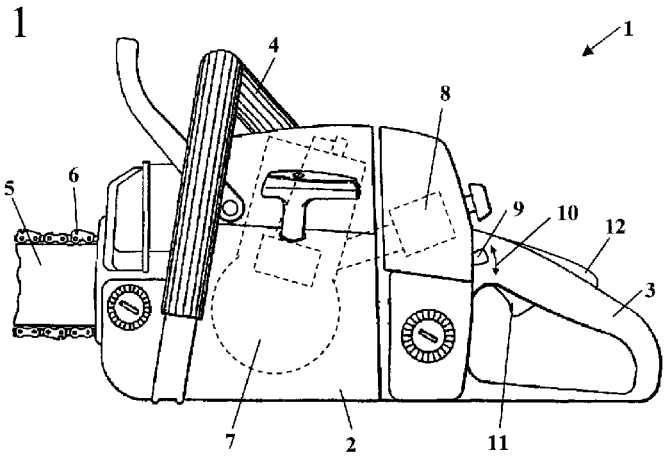
FIG. 1 shows a schematic side view of a handheld work apparatus.

FIG. 1 shows a chain saw 1 as an exemplary embodiment of a handheld work apparatus. As an alternative to the chain saw 1, it is also possible to provide another type of handheld work apparatus, such as a brushcutter, a cutoff machine or the like. The chain saw 1 has a housing 2, to which are fixed a rear handle 3 and a grip tube 4. A guide bar 5, on which is arranged a saw chain 6, projects forward from the front end of the housing at the opposite end from the rear handle 3. This saw chain 6 is driven in rotation by a combustion engine 7 arranged in the housing 2. The combustion engine 7 is advantageously an oil-in-gasoline lubricated two-stroke engine or an oil-in-gasoline lubricated four-stroke engine. The combustion engine 7 has a carburetor 8 for supplying air/fuel mixture.

A throttle lever 11 and a throttle lever lock 12 are arranged on the rear handle 3. Adjacent to the rear handle 3, an operating mode selector 9 projects out of the housing 2 and can be actuated in the direction of an arrow 10 by the operator. The operating mode selector 9 has a stop position, an operating position, a warm start position and a cold start position, which follow one another in that order.

Figure 2:
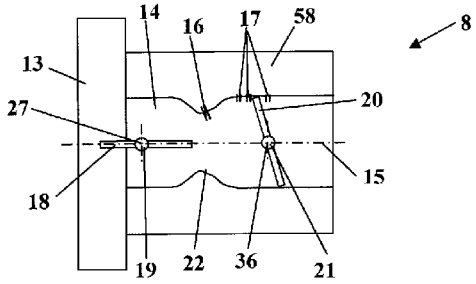
FIG. 2 shows a schematic of a carburetor.

FIG. 2 schematically shows the carburetor 8. The carburetor 8 has a carburetor housing 58, in which an intake channel 14 is formed. The intake channel 14 opens out at an air filter 13 arranged upstream of the carburetor 8. The intake channel 14 has an intake channel longitudinal axis 15. In the region of a primary fuel opening 16, which opens out into the intake channel 14, there is formed a venturi section 22 in the carburetor 8, which narrows the flow cross section in this region. A choke flap 18 with a choke shaft 19 is mounted pivotably about a first pivot axis 27 upstream of the venturi section 22. Secondary fuel openings 17 open out in the intake channel 14 downstream of the primary fuel opening 16. In the region of the secondary fuel openings 17, a throttle flap 20 with a throttle shaft 21 is mounted pivotably about a pivot axis 36.

Figure 3:
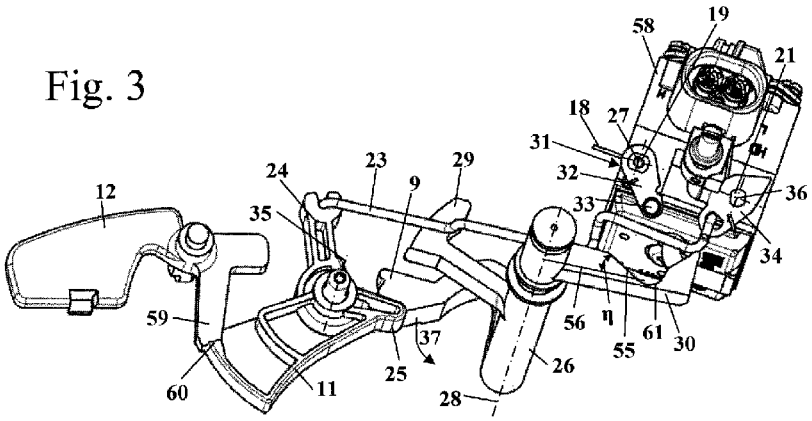
FIG. 3 shows a perspective view of a first exemplary embodiment of actuating shaft and carburetor in the operating position.

As shown in FIG. 3, on the outer side of the carburetor housing 58, a throttle trigger 34 is connected to the throttle shaft 21 fixedly in terms of rotation. Suspended from the throttle trigger 34 is an actuating rod 23, the other end of which is suspended from an actuating arm 24 of the throttle lever 11. As an alternative to the actuating rod 23, it is also possible to provide some other form of operative connection between the throttle lever 11 and the throttle trigger 34. The throttle lever 11 is mounted pivotably about a pivot axis 35. The throttle lever 11 has an edge 60 which, in the unactuated position shown in FIG. 3, bears against a lock portion 59 of the throttle lever lock 12. As a result, the throttle lever 11 cannot be actuated.

The operating mode selector 9 is formed integrally with an operating shaft 26 which is mounted pivotably about a second pivot axis 28. The pivot axis 28 has a distance from the first pivot axis 27 of the choke shaft 19 and is arranged obliquely with respect to the first pivot axis 27 of the choke shaft 19. On the operating shaft 26 are arranged a coupling lever 29 and an adjusting element 30, which in the exemplary embodiment are likewise formed integrally with the operating shaft 26.

The adjusting element 30 interacts with an actuating element 31 that is connected to the choke shaft 19 fixedly in terms of rotation. The actuating element 31 comprises an actuating lever 32, to which is fixed an actuating bolt 33 that projects in the axial direction of the first pivot axis 27 of the choke shaft 19. In the exemplary embodiment, the actuating bolt 33 has a round cross section. Other cross sections of the actuating bolt 33 may also be advantageous. The adjusting element 30 is formed as a lever which projects approximately radially to the second pivot axis 28 of the operating shaft 26 and has a groove 61 interacting with the actuating bolt 33.

The groove 61, on a flank, has a cam contour 55, which is formed as a flat surface and is inclined with respect to the radial direction 56 to the pivot axis 28. The cam contour 55 includes an angle ($\eta$) of advantageously from approximately 10° to approximately 50°, in particular approximately 20° to approximately 40°, with the radial direction 56. The adjusting element 30 is formed as a lever, on the outer side of which is arranged the groove 61 having the cam contour 55. The groove 61 forms a depression on the longitudinal side of the lever and is therefore simple to produce.

Figure 4:
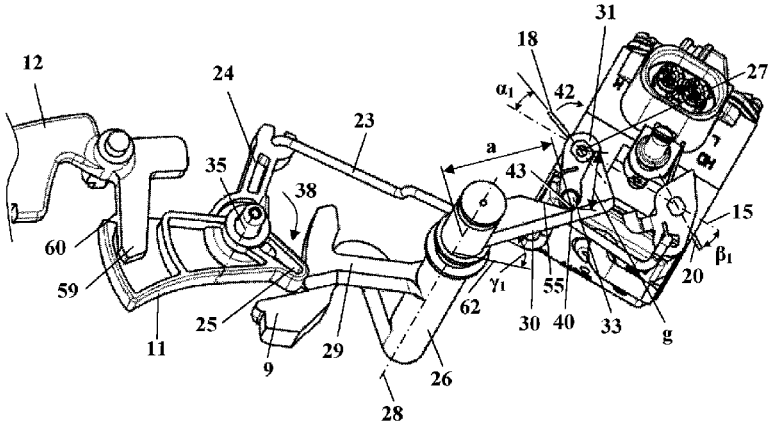
FIG. 4 shows the exemplary embodiment of FIG. 3 as a perspective view in the warm start position.

When the operating mode selector 9 is adjusted out of the operating position shown in FIG. 3 into the warm start position shown in FIG. 4, the operating mode selector 9 is pivoted in the direction of the arrow 37 (FIG. 3). After passing through an empty run, the adjusting element 30 engages with the actuating element 31 and pivots the choke flap 18. In predetermined positions, the coupling lever 29 interacts with a coupling arm 25 arranged on the throttle lever 11 and thereby pivots the throttle lever 11. In the warm start position shown in FIG. 4, the coupling lever 29 has pivoted the throttle lever 11 via the coupling arm 25 in the direction of arrow 38. Via the actuating rod 23, the throttle lever 11 pivots the throttle flap 20. To allow the pivoting movement of the operating mode selector 9, the operator must first of all, prior to actuation of the operating mode selector 9, actuate the throttle lever lock 12, so that the lock section 59 releases the edge 60 and the throttle lever 11 can be pivoted. If the throttle lever lock 12 is not actuated, the operating mode selector 9 cannot be pivoted into the warm start position, since the operating shaft 26 of the throttle lever 11 is blocked.

In the warm start position shown in FIG. 4, the actuating bolt 33 of the actuating element 31, by way of a first contact point 43 of the actuating bolt 33, bears against a first contact point 40 of the adjusting element 30. The contact point 40 has a distance (a) from the second pivot axis 28 of the operating shaft 26. The contact point 43 has a distance (g) from the first pivot axis 27 of the choke shaft 19. The adjusting element 30 has been pivoted by a pivot angle $\gamma_1$ with respect to the operating position shown in FIG. 3. The pivot angle $\gamma_1$ may, for example, be approximately 20° to approximately 40°. In FIG. 4, the pivot angle $\gamma_1$ is drawn between the adjusting element 30 and a line 62 that indicates the position of the adjusting element 30 in the operating position shown in FIG. 3. The choke flap 18 includes an angle $\alpha_1$ of advantageously from approximately 15° to approximately 30° with the intake channel longitudinal axis 15 in the warm start position. This corresponds to the pivot angle of choke flap 18 and actuating element 31 out of the operating position. The throttle flap 20 includes an angle $\beta_1$ of advantageously from approximately 20° to approximately 45° with the intake channel longitudinal axis 15 in the warm start position.

Figure 5:
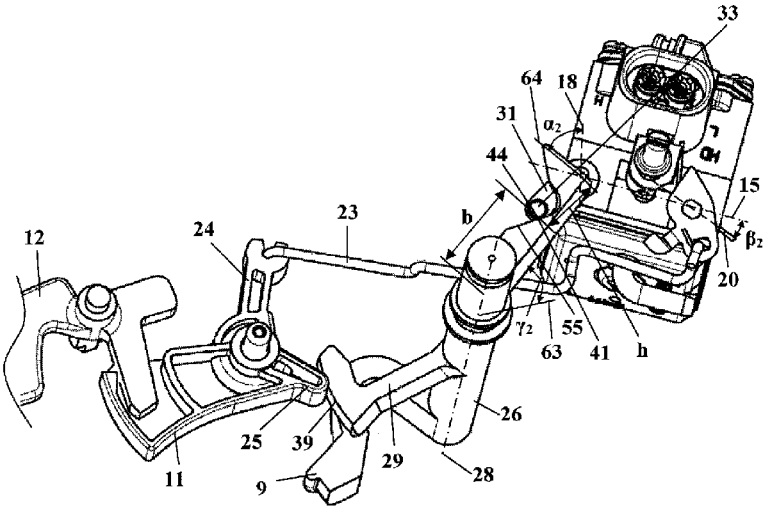
FIG. 5 shows the exemplary embodiment of FIG. 3 as a perspective view in the cold start position.

When the operating mode selector 9 is pivoted further, the operating shaft 26 is pivoted further. As shown in FIG. 5, in the process the coupling arm 25 of the throttle lever 11 slides along a cam contour 39 which is formed on the coupling lever 29 of the operating shaft 26.

With respect to the warm start position shown in FIG. 4, the operating shaft 26 and therefore also the adjusting element 30 have been pivoted by a pivot angle $\gamma_2$. The pivot angle $\gamma_2$ advantageously approximately corresponds to the pivot angle $\gamma_1$ and may, for example, be from approximately 20° to approximately 40°. The pivot angle $\gamma_2$ is shown in FIG. 4 between the adjusting element 30 and a line 63 indicating the position of the adjusting element 30 in the warm start position shown in FIG. 4. The choke flap 18, which is only schematically shown in FIG. 5, and the actuating element 31 have been adjusted by a pivot angle $\alpha_2$ of advantageously from approximately 20° to approximately 50° with respect to the warm start position. The pivot angle $\alpha_2$ is advantageously at least 1.5 times the pivot angle $\alpha_1$. The pivot angles $\alpha_2$ and $\gamma_2$ are shown with respect to the position in the warm start position. The warm start position of the choke flap 18 is schematically indicated as a line 64 in FIG. 5. The throttle flap 20 includes an angle $\beta_2$ which in the exemplary embodiment is slightly smaller than the angle $\beta_1$ with the intake channel longitudinal axis 15. The angle $\beta_2$, like the angle $\beta_1$, is measured with respect to the intake channel longitudinal axis 15. Accordingly, the throttle flap is open further in the cold start position than in the warm start position. The ratio of the pivot angle $\alpha_2$ to the pivot angle $\alpha_1$ is advantageously at least approximately 1.5 times the ratio of the pivot angle $\gamma_2$ to the pivot angle $\gamma_1$.

As shown in FIGS. 4 and 5, the actuating bolt 33 has slid along the cam contour 55 from the warm start position into the cold start position. In the cold start position, a second contact point 44 of the actuating bolt 33 bears against a second contact point 41 of the adjusting element 30. The contact point 44 is only slightly offset with respect to the first contact point 43 along the circumference of the actuating bolt 33, and consequently the two contact points 41 and 44 have only a negligibly small angular distance about the first pivot axis 27 of the choke flap 18. The second contact point 44 has a distance (h) from the first pivot axis 27 which approximately corresponds to the distance (g) in the warm start position.

The second contact point 41 of the adjusting element 30 has a distance (b) from the second pivot axis 28 of the operating shaft 26 which is less than the distance (a) in the warm start position.

The transmission ratio of the pivoting movement of the adjusting element 30 to the actuating element 31 results from the ratio of the lever lengths. The transmission, in the warm start position, results from the distance (g) of the first pivot axis 27 with respect to the first contact point 43 of the actuating element 31 divided by the distance (a) of the first contact point 40 from the second pivot axis 28 of the adjusting element 30. In the cold start position shown in FIG. 5, the transmission ratio results from the ratio of the corresponding distances (h, b) of the second contact points from the respectively associated pivot axes. Therefore, the transmission ratio is greater in the cold start position, on account of the smaller distance (b), than in the warm start position.

Figure 6:
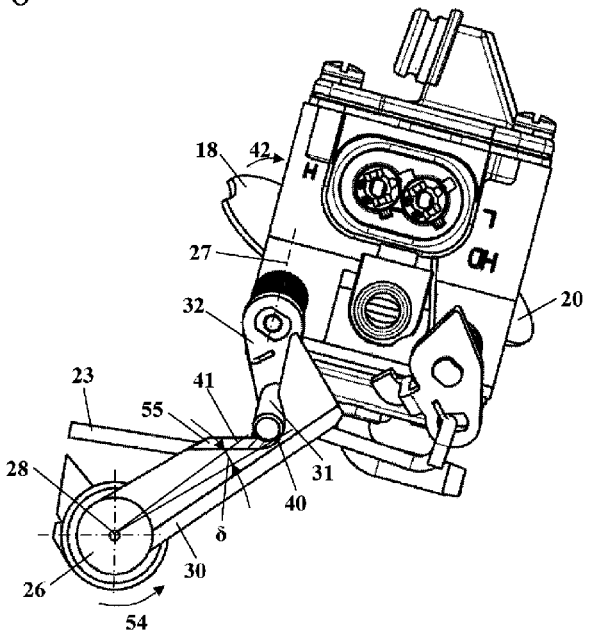
FIG. 6 shows an enlarged, perspective view in accordance with FIG. 4.

As shown in FIG. 6, the first contact point 40 and the second contact point 41 are offset from one another by an angle ($\delta$) in the circumferential direction with respect to the second pivot axis 28. The angle ($\delta$) is advantageously at least approximately 4°, in particular more than approximately 5°. On account of the oblique or skew arrangement of the first pivot axis 27 and the second pivot axis 28, the cam contour 55 is inclined with respect to the second pivot axis 28 and does not run parallel thereto. The second contact point 41 is offset with respect to the first contact point 40 in the adjusting direction 54 of the operating shaft 26 from the warm start position to the cold start position. On account of the offset in the circumferential direction with respect to the second pivot axis 28, during adjustment of the adjusting element 30 from the warm start position into the cold start position, the choke flap 18 is additionally adjusted in the closing direction 42 of the choke flap 18, that is, in the direction in which the choke flap 18 is moved from the open position into the closed position. The offset in the circumferential direction results from the inclination of the cam contour 55 with respect to the radial direction 56 (FIG. 3).

Figure 7:
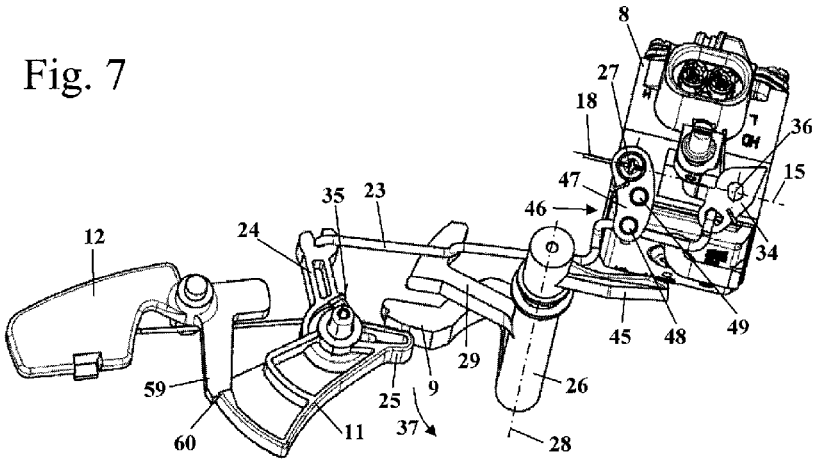
FIG. 7 shows a perspective view of a second exemplary embodiment in the operating position.
Figure 8:
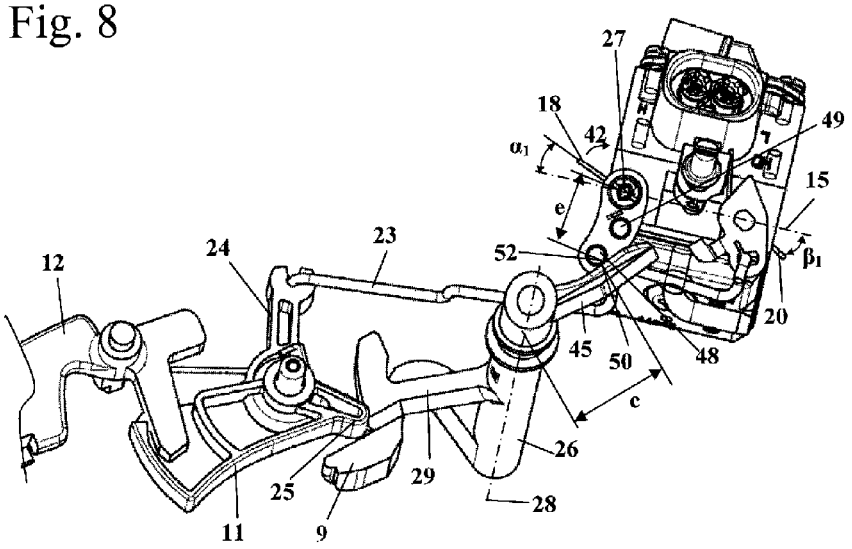
FIG. 8 shows the exemplary embodiment from FIG. 7 in the warm start position; and, FIG. 9 shows the exemplary embodiment from FIG. 7 in the cold start position.
Figure 9:
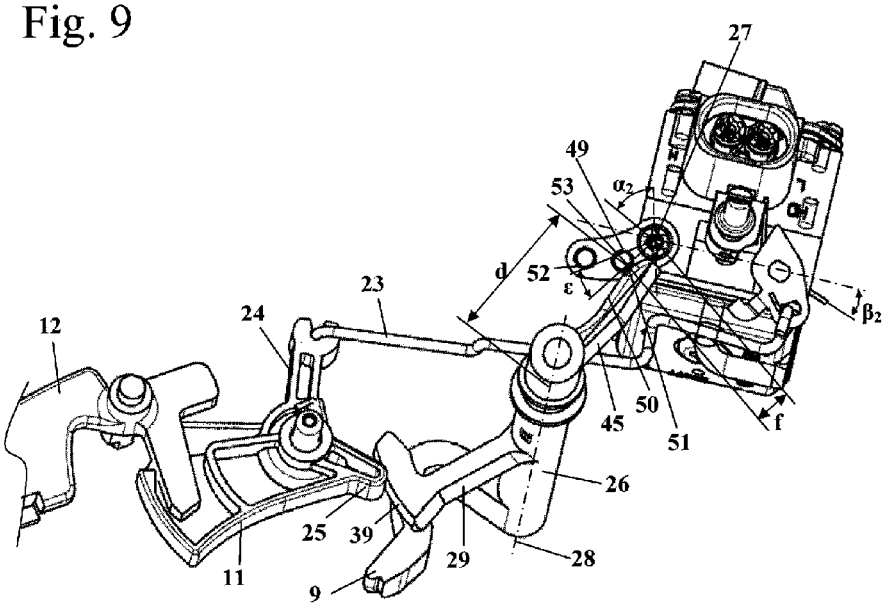

FIGS. 7 to 9 show a further exemplary embodiment. Identical reference symbols denote corresponding elements to those shown in the preceding figures. FIG. 7 shows the arrangement in the operating position. An adjusting element 45, which in the operating position does not make any contact with an actuating element 46 connected to the choke shaft 19 fixedly in terms of rotation (FIG. 2), is arranged, in particular formed integrally, on the operating shaft 26. The actuating element 46 has an actuating lever 47, to which a first actuating bolt 48 and a second actuating bolt 49 are fixed. The actuating bolts 48 and 49 have different distances from the first pivot axis 27 and are also offset with respect to one another in the circumferential direction with respect to the first pivot axis 27. In the operating position shown in FIG. 7, the choke flap 18 is fully open and the throttle flap 20 is closed, as shown in FIG. 2.

During adjustment of the operating mode selector 9 into the warm start position shown in FIG. 8 in the direction of the arrow 37 shown in FIG. 7, the adjusting element 45, after it has passed through an empty run, engages with the first actuating bolt 48. In the warm start position, a first contact point 52 of the actuating bolt 48 bears against a first contact point 50 of the adjusting element 45. The adjusting element 45 is formed as an approximately straight lever projecting approximately radially with respect to the second pivot axis 28. In the warm start position shown in FIG. 8, the first contact point 50 has a distance (c) from the second pivot axis 28. The distance (c) approximately corresponds to the distance (e) of the first contact point 52 on the first actuating bolt 48 from the first pivot axis 27, so that in this position a transmission ratio of approximately 1 results. In the warm start position, the choke flap includes an angle $\alpha_1$ with the intake channel longitudinal axis 15, and the throttle flap 20 includes an angle $\beta_1$. These angles correspond to the angles $\alpha_1$ and $\beta_1$ shown in FIG. 4.

If the operating mode selector 9 is pivoted out of the warm start position shown in FIG. 8 into the cold start position shown in FIG. 9, the choke flap 18 is pivoted in the closing direction 42 (FIG. 8), specifically by the pivot angle $\alpha_2$ shown in FIG. 9. The pivot angle $\alpha_2$ is significantly larger than the pivot angle $\alpha_1$ and may, for example, amount to approximately 1.5 times the pivot angle $\alpha_1$. During pivoting from the warm start position to the cold start position, the contact point against which the adjusting element 45 bears changes from the actuating bolt 48 to the actuating bolt 49. In the process, the transmission ratio changes suddenly.

In the cold start position shown in FIG. 9, a second contact point 51 of the adjusting element 45 bears against a second contact point 53 of the second actuating bolt 49. The contact points 50 and 51 of the adjusting element 45 lie approximately in the same radial direction with respect to the second pivot axis 28 of the operating shaft 26 and are not significantly offset with respect to one another in the circumferential direction with respect to the second pivot axis 28. The two contact points 52 and 53 of the actuating element 46 (FIG. 7) have an angular distance ($\epsilon$) which is more than 4°, advantageously at least approximately 10°, in particular at least approximately 15°. In the exemplary embodiment, the angular distance (e) is approximately 25°. The second contact point 53 is offset with respect to the first contact point 52 in the opposite direction to the closing direction 42 (FIG. 8) of the choke flap 18. On account of the angular distance ($\epsilon$), when the operating shaft 26 is pivoted out of the warm start position into the cold start position, the choke flap 18 is additionally pivoted in the closing direction 42. As shown in FIG. 9, the second contact point 51 of the adjusting element 45 has a distance (d) from the second pivot axis 28 that is significantly greater than the distance (c) in the warm start position. The second contact point 53 of the actuating element 46 has a distance (f) from the first pivot axis 27 of the choke flap 18 that is significantly smaller than the distance (e), for example by approximately two to three times. The ratio of the distance (e) to the distance (c) is greater than the ratio of the distance (f) to the distance (d), in particular at least twice as great. As a result, in the cold start position, a transmission ratio of significantly less than 1 is achieved. As a result, less accurate positioning of the choke flap 18 is possible in the cold start position than in the warm start position. However, accurate positioning is not necessary in the cold start position if the choke flap 18 is pressed against a stop in the cold start position. In the cold start position, accurate positioning of the choke flap 18 is not achieved via the operating shaft 26, but rather via the stop. A large pivot angle $\alpha_2$ is achieved on account of the low transmission ratio. The pivot angle $\alpha_2$ may be significantly greater than the pivot angle $\alpha_1$, whereas the pivot angles $\gamma_1$ and $\gamma_2$ of the operating shaft 26 (FIGS. 4 and 5) may be approximately equal. In FIGS. 8 and 9, the same pivot angles $\gamma_1$ and $\gamma_2$ are provided as in FIGS. 4 and 5, which are not shown in FIGS. 8 and 9 for the sake of clarity. It is also possible to provide different pivot angles $\gamma_1$ and $\gamma_2$ from those of the exemplary embodiment shown in FIGS. 4 and 5.

In the exemplary embodiment shown in FIGS. 3 to 6, the first contact point 43 and the second contact point 44 of the actuating element 31 approximately coincide. It is also possible for the two contact points on the adjusting element to approximately coincide and for only the contact points on the actuating element to be at a distance from one another. As a result of the angular distance between the two contact points on the actuating element and/or the contact points on the adjusting element, in each case as seen in the circumferential direction with respect to the associated pivot axis, an additional actuation of the choke element in the closing direction is achieved, allowing the choke element to be closed more quickly.

On account of the lower transmission ratio in the cold start position in the exemplary embodiment shown in FIGS. 7 to 9, it is possible to reach the cold start position quickly. Since accurate setting of the position of the choke element is not necessary in the cold start position, a very small transmission ratio is sufficient. In the warm start position, the position of the choke element needs to be set relatively accurately, and consequently a larger transmission ratio is advantageous here.

It is also possible for actuating bolts to be provided on the adjusting element of the operating shaft. Other elements may also be advantageous for producing an operative connection between adjusting element and actuating element.

It is understood that the foregoing description is that of the preferred embodiments of the invention and that various changes and modifications may be made thereto without departing from the spirit and scope of the invention as defined in the appended claims.

What is claimed is:

1. A portable handheld work apparatus comprising:

a work tool;

a combustion engine for driving said work tool;

said combustion engine including a carburetor for supplying an air/fuel mixture;

said carburetor including a throttle element and a choke element accommodated therein;

said choke element having a choke shaft defining a first pivot axis;

said choke element being mounted in said carburetor with said choke shaft so as to be pivotable about said first pivot axis;

said choke element including an actuating element operatively connected to said choke shaft;

a throttle lever;

an operating-mode selector mounted in said apparatus so as to be pivotable about a second pivot axis to an operating position, a warm-start position and a cold-start position;

an adjusting element connected to said operating-mode selector so as to be fixedly rotatable therewith and coact with said actuating element in said warm-start position and said cold-start position;

said adjusting element having a first contact location corresponding to said warm-start position and a second contact location corresponding to said cold-start position;

said actuating element having a first contact location corresponding to said warm-start position and a second contact location corresponding to said cold-start position;

said choke element being displaced in a closing direction in response to a shift of said operating-mode selector from said warm-start position whereat said first contact location of said adjusting element coacts with said first contact location of said actuating element into said cold-start position whereat said second contact location of said adjusting element coacts with said second contact location of said actuating element;

said actuating element being pivoted through a first pivot angle ($\alpha_1$) when pivoted from said operating position into said warm-start position and through a second pivot angle ($\alpha_2$) when pivoted from said warm-start position into said cold-start position; whereas, said operating-mode selector being pivoted through a third pivot angle ($\gamma_1$) when said operating-mode selector is pivoted from said operating position into said warm-start position and through a fourth pivot angle ($\gamma_2$) when pivoted from said warm-start position into said cold-start position; and, wherein a ratio of said second pivot angle ($\alpha_2$) to said first pivot angle ($\alpha_1$) is at least approximately 1.5 times a ratio of said fourth pivot angle ($\gamma_2$) to said third pivot angle ($\gamma_1$).

2. The portable handheld work apparatus of claim 1, wherein said first contact location and said second contact location of said actuating element and/or of said adjusting element define an angular spacing ($\delta$, $\epsilon$) in peripheral direction to the corresponding first pivot axis and said second pivot axis with said angular spacing ($\delta$, $\epsilon$) being at least approximately 4°; and, said angular spacing ($\delta$, $\epsilon$) causes an additional movement of said choke element in said closing direction with a displacement of said operating-mode selector from said warm-start position into said cold-start position.

3. The portable handheld work apparatus of claim 2, wherein said angular spacing ($\delta$, $\epsilon$) is more than approximately 10°.

4. The portable handheld work apparatus of claim 2, wherein said first contact location and said second contact location of said adjusting element have said angular spacing ($\delta$); and, said second contact location of said adjusting element is offset relative to the first contact location of said adjusting element viewed in the displacement direction of the adjusting element from the warm-start position into the cold-start position.

5. The portable handheld work apparatus of claim 4, wherein said second contact location has a lesser spacing (b) to said second pivot axis of said adjusting element than said first contact location of said adjusting element.

6. The portable handheld work apparatus of claim 1, wherein said first contact location and said second contact location of said actuating element are at an angular spacing ($\epsilon$); and, said second contact location of said actuating element lies offset relative to said first contact location in a direction opposite to said closing direction of said choke element.

7. The portable handheld work apparatus of claim 1, wherein the ratio of the distance (e) of the first contact location of said actuating element to said first pivot axis to the distance (c) of said first contact location of said adjusting element to said second pivot axis is greater than the ratio of the distance (f) of said second contact location of said actuating element to said first pivot axis to the distance (d) of the second contact location of the adjusting element to said second pivot axis.

8. The portable handheld work apparatus of claim 7, wherein the ratio of the distance (e) of the first contact location of the actuating element to the first pivot axis to the distance (c) of the first contact location of the adjusting element to said second pivot axis is at least twice as great as the ratio of the distance (f) of said second contact location of said actuating element to said first pivot axis to the distance (d) of said second contact location of said adjusting element to said second pivot axis.

9. The portable handheld work apparatus of claim 7, wherein said second contact location of said actuating element has a smaller distance (f) to said first pivot axis of said actuating element than said first contact location of said actuating element.

10. The portable handheld work apparatus of claim 7, wherein said second contact location of said adjusting element has a greater distance (d) to said second pivot axis of said adjusting element than said first contact location of said adjusting element.

11. The portable handheld work apparatus of claim 1, wherein said second pivot angle ($\alpha_2$) is at least one and one-half times as great as the first pivot angle ($\alpha_1$).

12. A portable handheld work apparatus comprising:

a work tool;

a combustion engine for driving said work tool;

said combustion engine including a carburetor for supplying an air/fuel mixture;

said carburetor including a throttle element and a choke element accommodated therein;

said choke element having a choke shaft defining a first pivot axis;

said choke element being mounted in said carburetor with said choke shaft so as to be pivotable about said first pivot axis;

said choke element including an actuating element operatively connected to said choke shaft;

a throttle lever;

an operating-mode selector mounted in said apparatus so as to be pivotable about a second pivot axis to an operating position, a warm-start position and a cold-start position;

an adjusting element connected to said operating-mode selector so as to be fixedly rotatable therewith and coact with said actuating element in said warm-start position and said cold-start position;

said adjusting element having a first contact location corresponding to said warm-start position and a second contact location corresponding to said cold-start position;

said actuating element having a first contact location corresponding to said warm-start position and a second contact location corresponding to said cold-start position;

said choke element being displaced in a closing direction in response to a shift of said operating-mode selector from said warm-start position whereat said first contact location of said adjusting element coacts with said first contact location of said actuating element into said cold-start position whereat said second contact location of said adjusting element coacts with said second contact location of said actuating element;

said actuating element being pivoted through a first pivot angle ($\alpha_1$) when pivoted from said operating position into said warm-start position and through a second pivot angle ($\alpha_2$) when pivoted from said warm-start position into said cold-start position; whereas, said operating-mode selector being pivoted through a third pivot angle ($\gamma_1$) when said operating-mode selector is pivoted from said operating position into said warm-start position and through a fourth pivot angle ($\gamma_2$) when pivoted from said warm-start position into said cold-start position;

wherein a ratio of said second pivot angle ($\alpha_2$) to said first pivot angle ($\alpha_1$) is at least approximately 1.5 times a ratio of said fourth pivot angle ($\gamma_2$) to said third pivot angle ($\gamma_1$); and, wherein said first contact location is configured on a first actuating bolt and the second contact location is configured on a second actuating bolt.

13. The portable handheld work apparatus of claim 12, wherein the actuating element comprises said actuating bolts.

14. The portable handheld work apparatus of claim 1, wherein the first contact location and the second contact location of said adjusting element are formed on a cam contour.

15. The portable handheld work apparatus of claim 14, wherein said cam contour runs evenly and is inclined at an angle ($\eta$) to the radial direction of the assigned pivot axis.

16. The portable handheld work apparatus of claim 15, wherein said angle ($\eta$) lies in a range of approximately 10° to approximately 50°.

17. The portable handheld work apparatus of claim 14, wherein the adjusting element comprises said cam contour; and, said adjusting element is configured as a lever having an outer side on which said cam contour is formed.

18. The portable handheld work apparatus of claim 1, wherein said operating-mode selector and said adjusting element are arranged on a common operator-controlled shaft.

19. The portable handheld work apparatus of claim 18, further comprising a first coupling element arranged on said operator-controlled shaft; a second coupling element mounted on said throttle lever; said first coupling element being operatively connected to said second coupling element so as to coact therewith; and, said throttle lever being pivoted with a displacement of said operating-mode selector into said warm-start position or into said cold-start position.

20. A portable handheld work apparatus comprising:

a work tool;

a combustion engine for driving said work tool;

said combustion engine including a carburetor for supplying an air/fuel mixture;

said carburetor including a throttle element and a choke element accommodated therein;

said choke element having a choke shaft defining a first pivot axis;

said choke element being mounted in said carburetor with said choke shaft so as to be pivotable about said first pivot axis;

said choke element including an actuating element operatively connected to said choke shaft;

a throttle lever;

an operating-mode selector mounted in said apparatus so as to be pivotable about a second pivot axis to an operating position, a warm-start position and a cold-start position;

an adjusting element connected to said operating-mode selector so as to be fixedly rotatable therewith and coact with said actuating element in said warm-start position and said cold-start position;

said adjusting element having a first contact location corresponding to said warm-start position and a second contact location corresponding to said cold-start position;

said actuating element having a first contact location corresponding to said warm-start position and a second contact location corresponding to said cold-start position;

said choke element being displaced in a closing direction in response to a shift of said operating-mode selector from said warm-start position whereat said first contact location of said adjusting element coacts with said first contact location of said actuating element into said cold-start position whereat said second contact location of said adjusting element coacts with said second contact location of said actuating element;

said actuating element being pivoted through a first pivot angle ($\alpha_1$) when pivoted from said operating position into said warm-start position and through a second pivot angle ($\alpha_2$) when pivoted from said warm-start position into said cold-start position; whereas, said operating-mode selector being pivoted through a third pivot angle ($\gamma_1$) when said operating-mode selector is pivoted from said operating position into said warm-start position and through a fourth pivot angle ($\gamma_2$) when pivoted from said warm-start position into said cold-start position;

wherein a ratio of said second pivot angle ($\alpha_2$) to said first pivot angle ($\alpha_1$) is at least approximately 1.5 times a ratio of said fourth pivot angle ($\gamma_2$) to said third pivot angle ($\gamma_1$); and, wherein said third pivot angle ($\gamma_1$) is approximately of the same magnitude as said fourth pivot angle ($\gamma_2$) and said second pivot angle ($\alpha_2$) is at least 1.5 times as large as said first pivot angle ($\alpha_1$).

* * * * *